US009482074B2

(12) United States Patent
Reid et al.

(10) Patent No.: US 9,482,074 B2
(45) Date of Patent: Nov. 1, 2016

(54) VALVE ACTUATING APPARATUS

(71) Applicant: Halliburton Manufacturing & Services Limited, Leatherhead (GB)

(72) Inventors: Michael Adam Reid, Scotlant (GB); Gary Henry Smith, Scotland (GB)

(73) Assignee: HALLIBURTON MANUFACTURING & SERVICES LIMITED, Leatherhead (GB)

( * ) Notice: Subject to any disclaimer, the term of this patent is extended or adjusted under 35 U.S.C. 154(b) by 665 days.

(21) Appl. No.: 13/648,470

(22) Filed: Oct. 10, 2012

(65) Prior Publication Data

US 2013/0087341 A1 Apr. 11, 2013

(30) Foreign Application Priority Data

Oct. 11, 2011 (GB) ..... 1117502.3

(51) Int. Cl.
*E21B 34/14* (2006.01)

(52) U.S. Cl.
CPC ..... *E21B 34/14* (2013.01)

(58) Field of Classification Search
CPC ..... E21B 34/06–34/16
See application file for complete search history.

(56) References Cited

U.S. PATENT DOCUMENTS

| | | | |
|---|---|---|---|
| 1,448,818 | A | 3/1923 | Stokes |
| 2,042,817 | A | 6/1936 | Wilcox |
| 2,599,774 | A | 6/1952 | Ohls |
| 2,710,655 | A | 6/1955 | Haskell |
| 2,883,146 | A | 4/1959 | Knox |
| 2,916,254 | A | 12/1959 | Wendell |
| 3,072,379 | A | 1/1963 | Hamer |
| 3,241,808 | A | 3/1966 | Allen |
| 3,395,758 | A | 8/1968 | Kelly et al. |
| 3,424,190 | A | 1/1969 | Wolfensperger |
| 3,472,484 | A | 10/1969 | Parker |
| 3,503,445 | A | 3/1970 | Cochrum et al. |
| 3,581,820 | A | 6/1971 | Burns |
| 3,675,718 | A | 7/1972 | Kanady |
| 3,732,925 | A | 5/1973 | Kanady |

(Continued)

FOREIGN PATENT DOCUMENTS

| | | |
|---|---|---|
| CA | 2485810 | 4/2005 |
| EP | 0427371 | 5/1991 |

(Continued)

OTHER PUBLICATIONS

UK Intellectual Property Office, Search Report of UK Patent Application No. GB 1117502.3 (foreign priority application), Jan. 20, 2012. Search Report issued in connection with UK priority patent application prior to filing instant U.S. patent application.

(Continued)

*Primary Examiner* — Blake Michener

(57) ABSTRACT

An actuating apparatus for a downhole valve including a tubular body, which includes an axial bore that extends through the body. The actuating apparatus also includes an operating member that is adapted to move relative to the tubular body. The movement of the operating member relative to the tubular body is between a first position and a second position such that fluid contained within a reservoir is displaced when such a downhole valve is actuated. The actuating apparatus is adapted to be fluidly coupled to the downhole valve.

18 Claims, 2 Drawing Sheets

(56) References Cited

U.S. PATENT DOCUMENTS

| | | | | |
|---|---|---|---|---|
| 3,815,676 | A | 6/1974 | Read | |
| 3,960,363 | A | 6/1976 | Domyan | |
| 3,061,267 | A | 10/1976 | Hamer | |
| 3,993,130 | A | 11/1976 | Papp | |
| 4,022,426 | A | 5/1977 | Read | |
| 4,022,427 | A | 5/1977 | Read | |
| 4,029,292 | A | 6/1977 | Kramer et al. | |
| 4,080,982 | A | 3/1978 | Maezawa | |
| 4,119,146 | A | 10/1978 | Taylor | |
| 4,249,599 | A | 2/1981 | Krause | |
| 4,281,715 | A | 8/1981 | Farley | |
| 4,315,542 | A | 2/1982 | Dockins, Jr. | |
| 4,355,685 | A | 10/1982 | Beck | |
| 4,406,335 | A | 9/1983 | Koot et al. | |
| 4,421,174 | A | 12/1983 | McStravick et al. | |
| 4,506,693 | A | 3/1985 | Acker | |
| 4,519,579 | A | 5/1985 | Brestel et al. | |
| 4,606,368 | A | 8/1986 | McCafferty | |
| 4,616,857 | A | 10/1986 | Woodman et al. | |
| 4,700,924 | A | 10/1987 | Nelson et al. | |
| 4,709,762 | A | 12/1987 | Pringle et al. | |
| 4,776,395 | A | 10/1988 | Baker et al. | |
| 4,782,896 | A | 11/1988 | Witten | |
| 4,796,705 | A | 1/1989 | Carmody et al. | |
| 4,815,701 | A | 3/1989 | Stone | |
| 4,903,775 | A | 2/1990 | Manke | |
| 4,921,044 | A | 5/1990 | Cooksey | |
| 4,949,788 | A | 8/1990 | Szarka et al. | |
| 4,991,654 | A | 2/1991 | Brandell et al. | |
| 5,101,907 | A * | 4/1992 | Schultz et al. | 166/386 |
| 5,263,683 | A | 11/1993 | Wong | |
| 5,316,084 | A | 5/1994 | Murray et al. | |
| 5,529,126 | A | 6/1996 | Edwards | |
| 5,547,029 | A | 8/1996 | Rubbo et al. | |
| 5,615,548 | A | 4/1997 | Winfree et al. | |
| 5,865,246 | A | 2/1999 | Brown | |
| 5,875,852 | A | 3/1999 | Floyd et al. | |
| 5,911,285 | A | 6/1999 | Stewart et al. | |
| 6,003,834 | A | 12/1999 | Read | |
| 6,041,864 | A * | 3/2000 | Patel et al. | 166/332.4 |
| 6,044,908 | A | 4/2000 | Wyatt | |
| 6,145,595 | A | 11/2000 | Burris | |
| 6,276,458 | B1 | 8/2001 | Malone et al. | |
| 6,298,919 | B1 | 10/2001 | Browne et al. | |
| 6,308,783 | B2 | 10/2001 | Pringle et al. | |
| 6,315,047 | B1 | 11/2001 | Deaton et al. | |
| 6,450,255 | B2 | 9/2002 | Carmody et al. | |
| 6,550,541 | B2 | 4/2003 | Patel | |
| 6,575,237 | B2 | 6/2003 | Purkis et al. | |
| 6,668,936 | B2 | 12/2003 | Williamson et al. | |
| 6,684,950 | B2 * | 2/2004 | Patel | 166/250.01 |
| 6,715,558 | B2 | 4/2004 | Williamson | |
| 6,776,240 | B2 | 8/2004 | Kenison et al. | |
| 6,782,952 | B2 | 8/2004 | Garay et al. | |
| 6,860,330 | B2 | 3/2005 | Jackson | |
| 6,880,638 | B2 | 4/2005 | Haughom et al. | |
| 6,951,331 | B2 | 10/2005 | Haughom et al. | |
| 6,974,121 | B2 | 12/2005 | Koester et al. | |
| 7,204,315 | B2 | 4/2007 | Pia | |
| 7,258,323 | B2 | 8/2007 | Dwivedi | |
| 7,306,043 | B2 | 12/2007 | Toekje et al. | |
| 7,597,150 | B2 * | 10/2009 | Clem | 166/334.4 |
| 7,614,452 | B2 | 11/2009 | Kenison et al. | |
| 7,690,432 | B2 * | 4/2010 | Noske et al. | 166/319 |
| 8,316,953 | B2 | 11/2012 | Reid | |
| 8,602,112 | B2 | 12/2013 | Reid | |
| 2002/0046845 | A1 | 4/2002 | Rayssiguier et al. | |
| 2002/0053438 | A1 | 5/2002 | Williamson, Jr. | |
| 2002/0066574 | A1 | 6/2002 | Leismer et al. | |
| 2003/0047702 | A1 | 3/2003 | Gunnarsson et al. | |
| 2004/0035578 | A1 | 2/2004 | Ross et al. | |
| 2004/0041120 | A1 | 3/2004 | Haughom et al. | |
| 2004/0046143 | A1 | 3/2004 | Haughom et al. | |
| 2004/0112608 | A1 | 6/2004 | Jackson | |
| 2004/0154839 | A1 | 8/2004 | McGarian et al. | |
| 2005/0087344 | A1 | 4/2005 | Toekje et al. | |
| 2005/0151107 | A1 | 7/2005 | Shu | |
| 2005/0224235 | A1 | 10/2005 | Patel | |
| 2005/0230118 | A1 * | 10/2005 | Noske et al. | 166/332.8 |
| 2007/0102163 | A1 | 5/2007 | Heath et al. | |
| 2007/0187106 | A1 | 8/2007 | Wolters | |
| 2007/0187107 | A1 * | 8/2007 | Pringle | E21B 23/006 166/319 |
| 2007/0204999 | A1 | 9/2007 | Cowie et al. | |
| 2008/0203346 | A1 | 8/2008 | Shu | |
| 2009/0050335 | A1 | 2/2009 | Mandrou | |
| 2009/0071658 | A1 | 3/2009 | Reid et al. | |
| 2009/0288838 | A1 * | 11/2009 | Richards | E21B 34/063 166/374 |
| 2010/0071962 | A1 | 3/2010 | Beuershausen | |
| 2011/0000679 | A1 | 1/2011 | Joseph et al. | |
| 2011/0061875 | A1 | 3/2011 | Tips et al. | |
| 2011/0203809 | A1 | 8/2011 | Knobloch, Jr. et al. | |
| 2012/0261137 | A1 | 10/2012 | Martinez et al. | |
| 2012/0312547 | A1 * | 12/2012 | Miller | E21B 34/10 166/373 |
| 2013/0000922 | A1 * | 1/2013 | Skinner et al. | 166/373 |
| 2013/0087344 | A1 | 4/2013 | Reid | |
| 2013/0092380 | A1 | 4/2013 | Reid | |
| 2013/0098624 | A1 | 4/2013 | Reid | |

FOREIGN PATENT DOCUMENTS

| | | |
|---|---|---|
| EP | 1136649 | 9/2001 |
| EP | 1241322 | 3/2002 |
| EP | 1350007 | 10/2005 |
| EP | 1350008 | 10/2005 |
| GB | 939999 | 10/1963 |
| GB | 2201979 | 9/1988 |
| GB | 2293433 | 3/1996 |
| GB | 2344152 | 5/2000 |
| GB | 2377743 | 1/2003 |
| GB | 2388854 | 11/2003 |
| GB | 2396633 | 6/2004 |
| GB | 2397316 | 7/2004 |
| GB | 2411677 | 9/2005 |
| GB | 2425585 | 11/2006 |
| GB | 2434814 | 8/2007 |
| GB | 2451288 | 1/2009 |
| GB | 2473092 | 3/2011 |
| WO | WO99/45231 | 9/1999 |
| WO | WO01/86113 | 11/2001 |
| WO | WO03/001019 | 1/2003 |
| WO | WO2004057689 | 7/2004 |
| WO | WO2005052302 | 6/2005 |
| WO | WO2005052313 | 6/2005 |
| WO | WO2009033018 | 3/2009 |
| WO | WO2009132462 | 11/2009 |
| WO | WO2010129631 | 11/2010 |
| WO | WO2011002676 | 1/2011 |
| WO | WO2011072367 | 6/2011 |

OTHER PUBLICATIONS

Extended European Search Report, European Application No. 12185092.9, Mar. 18, 2014, 5 pages.

Extended European Search Report, European Application No. 14195113.7, Mar. 13, 2015, 5 pages.

Fisher Product Bulletin—"Type Vee-Ball Designs V150, V200 and V300", Rotary Control Valves, Apr. 2005.

PCT/GB2006/000669; International Preliminary Report dated Aug. 28, 2007.

PCT/GB2006/000669; International Search Report dated Jun. 14, 2006.

UK Intellectual Property Office, Search Report of UK Patent Application No. GB 1117505.6 (foreign priority application), Jan. 19, 2012. Search report issued in connection with UK priority application prior to filing instant US patent application.

(56) References Cited

OTHER PUBLICATIONS

UK Intellectual Property Office, Search Report of UK Patent Application No. GB 1117507.2 (foreign priority application), Jan. 20, 2012. Search Report issued in connection with UK priority patent application prior to filing instant U.S. patent application.

UK Intellectual Property Office, Search Report of UK Patent Application No. GB 1117511.4 (foreign priority application), Jan. 22, 2012. Search report issued in connection with UK priority application prior to filing instant US patent application.

UK Search Report: Appln. GB1019746.5; Date of Search: Jan. 28, 2011.

* cited by examiner

VALVE ACTUATING APPARATUS

CROSS REFERENCE TO RELATED APPLICATIONS

The present application claims priority to United Kingdom Patent Application No. GB1117502.3, filed Oct. 11, 2011, and titled VALVE ACTUATING APPARATUS, the contents of which are expressly incorporated herein by reference.

BACKGROUND OF THE INVENTION

1. Field of the Invention

The present invention relates to valve actuating apparatus operable to actuate a downhole valve assembly. In particular, the present invention relates to a valve actuating apparatus that provides a contingency/back-up device operable to actuate a downhole valve that has failed to operate.

2. Description of the Related Art

Well completion involves various downhole procedures prior to allowing production fluids to flow thereby bringing the well on line. One of the downhole procedures routinely carried out during well completion is pressure testing where one downhole section of the well is isolated from another downhole section of the well by a closed valve mechanism such that the integrity of the wellbore casing/liner can be tested.

Well completion generally involves the assembly of downhole tubulars and equipment that is required to enable safe and efficient production from a well. In the following, well completion is described as being carried out in stages/sections. The integrity of each section may be tested before introducing the next section. The terms lower completion, intermediate completion and upper completion are used to describe separate completion stages that are fluidly coupled or in fluid communication with the next completion stage to allow production fluid to flow.

Lower completion refers to the portion of the well that is across the production or injection zone and which comprises perforations in the case of a cemented casing such that production flow can enter the inside of the production tubing such that production fluid can flow towards the surface.

Intermediate completion refers to the completion stage that is fluidly coupled to the lower completion and upper completion refers to the section of the well that extends from the intermediate completion to carry production fluid to the surface.

During testing of the intermediate completion stage the lower completion is isolated from the intermediate completion by a closed valve located in the intermediate completion. When the integrity of the tubing forming the intermediate completion section is confirmed the upper completion stage can be run-in.

Generally the completion stages are run-in with valves open and then the valves are subsequently closed such that the completion stages can be isolated from each other and the integrity of the production tubing and the well casing/wall can be tested.

Typically, the valves remain downhole and are opened to allow production fluids to flow. By opening the valves the flow of production fluids is not impeded.

In the event that a valve fails to open, for example where the valve or an actuating mechanism operable to open the valve becomes jammed, remedial action is generally required because a failed valve effectively blocks the production path.

Remedial action often involves removing the valve. The valve may be removed by milling or drilling the valve out of the wellbore to provide a free flowing path for production fluid.

It will be appreciated that resorting to such remedial action can result in costly downtime because production from the well is stopped or delayed. The remedial action may result in damage to the well itself where milling or drilling the valve or valves from the wellbore may create perforations in the production tubing or the well casing or well lining. As a result such actions would preferably be avoided.

In the above the importance of opening a valve to allow production to flow has been discussed. However, in the situation of a producing well requiring workover it is equally important to be able to isolate sections of the well to stop/halt production flow.

Workover requires that the well is shut-in below the surface or the well must first be killed.

Often in preparation for workover the completion assembly is removed, however, sometimes due to the placement of a packer in the well, for example a permanent packer, it can be problematic to remove a completion string for workover. Therefore, an alternative to retrieving the completion string is to isolate the well by shutting off production by closing a downhole valve. Conventionally, control lines from surface facilitate fluid communication downhole to the valves in order to close the valves.

However, in the event that the valve fails to close other operations to prepare the well for workover may be implemented such as killing the well. A well can be killed by using reverse circulation or by pumping heavy weight fluids into the well. It is desirable to provide a downhole device such that production downtime due to a failed valve is reduced.

It is further desirable to provide an actuating apparatus that provides a secondary actuating mechanism operable to actuate a failed valve located in the wellbore.

BRIEF SUMMARY OF THE INVENTION

A first aspect of the present invention provides an actuating apparatus for a downhole valve; the actuating apparatus comprises:

a tubular body comprising an axial bore extending through the body;

an operating member adapted to move relative to the tubular body; and a reservoir adapted to contain fluid;

wherein the operating member is movable relative to the tubular body between a first position and a second position to displace fluid contained within the reservoir and thereby actuate a downhole valve, wherein the actuating apparatus is adapted to be fluidly coupled to the downhole valve.

The operating member may be arranged within the axial bore of the tubular body.

The operating member may comprise a sleeve.

The reservoir may be defined by an annulus region defined between the operating member and the tubular body. The reservoir may comprise an inlet port and an outlet port. The outlet port may be fluidly coupled to a downhole valve.

The actuating apparatus may further comprise a piston member.

The operating member may comprise a piston member.

The piston member may be arranged to compress and displace fluid contained in the reservoir via the outlet port of the reservoir to the inlet port of a downhole valve such that the downhole valve may be actuated.

Movement of the operating member may compress and displace the fluid by action of the piston member on the fluid such that the downhole valve is actuated. Displacement of the fluid from the reservoir and actuation of the downhole valve may occur simultaneously.

The piston member may be arranged on a downhole side of the reservoir.

Movement of the operating member may be in either direction. For example, movement of the operating member in an uphole or downhole direction may displace fluid (by action of the piston member) in a generally downhole direction such that a downhole valve is actuated.

Fluid communication between the actuating apparatus and the downhole valve may be provided by a conduit extending from the outlet port to the downhole valve. The conduit may be contained within a downhole completion.

The operating member may comprise a coupling member. The coupling member may be configured to mechanically engage with a corresponding coupling member of a downhole tool such as a stinger or shifting tool.

Removal of the downhole tool, in a generally uphole direction may cause engagement of the coupling member of the downhole tool with the coupling member of the operating member such that the operating member may slide relative to the tubular body. Extraction of the downhole tool in conjunction with the operating member may move the operating member such that the downhole valve is actuated.

The coupling member of the downhole tool and the coupling member of the operating member may disengage following successful actuation of the downhole valve.

The downhole valve may be located downhole of the actuating apparatus.

The actuating apparatus according to embodiments of the present invention may provide a secondary actuator that is operable to actuate a valve that has failed to operate in response to primary actuation.

The actuating apparatus according to the present invention may be operable to open or close a downhole valve.

BRIEF DESCRIPTION OF THE SEVERAL VIEWS OF THE DRAWINGS

Embodiments of the present invention will now be described, by way of example only, with reference to the accompanying drawings, in which.

DETAILED DESCRIPTION OF THE INVENTION

Figure 1:
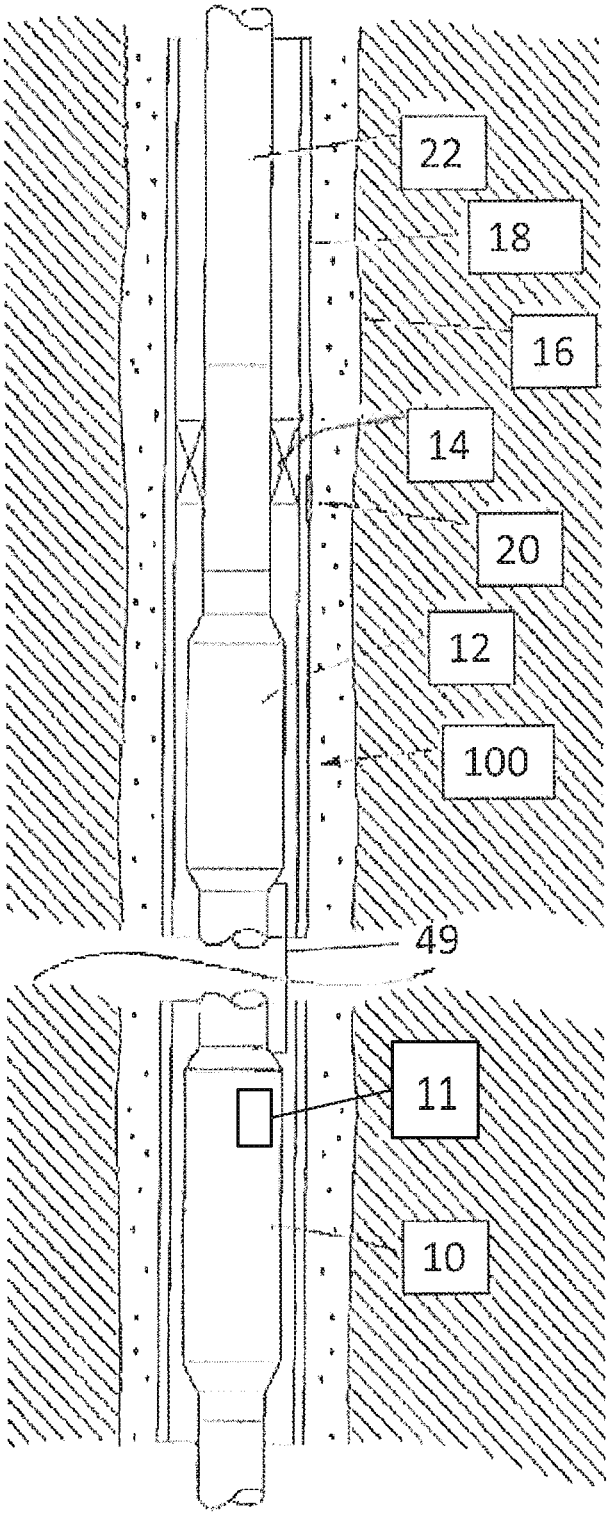
FIG. 1 is a schematic representation of a wellbore assembly comprising an actuating apparatus in accordance with an embodiment of the present invention.

Referring to FIG. 1, a partial longitudinal view of a wellbore completion arrangement 100 is illustrated. The wellbore completion arrangement 100 comprises a downhole valve assembly 10, an actuating apparatus 12 and a packer assembly 14.

In the illustrated example, a wellbore 16 is lined with a casing 18, which in the illustrated embodiment is held in place with cement 20.

The downhole valve assembly 10, the actuating apparatus 12 and the packer assembly 14 are all run into the wellbore as part of the well completion assembly 100 on a stinger (not illustrated). The actuating apparatus 12 and the downhole valve assembly are connected by a conduit 49 that allows for hydraulic actuation of the downhole valve 10 in the event that it fails to actuate due to primary actuation.

For illustrative purposes, FIG. 1 does not indicate any specific form or type of downhole valve assembly 10. Suitable valve assemblies 10 will be discussed further below with respect to the action of the actuating apparatus 12 according to embodiments of the present invention.

The packer assembly 14 provides a seal in the annulus region 15, which is defined by the space between the outside of the production tubing 22 and the inside of the casing 18.

In the illustrated embodiment the downhole valve assembly 10 is run-in in an open configuration and is subsequently closed when it has reached its location downhole. Once closed, fluid pressure can be applied from above the downhole valve assembly 10 to check the integrity of the production tubing 22. Following successful testing, the downhole valve assembly 10 can be opened again such that production fluid can flow unimpeded through the downhole valve assembly 10 when the well is brought on line.

"The downhole valve assembly 10 can be opened by a suitable primary actuating apparatus 11, which may include, for example, fluid pressure from control lines to the surface, mechanical actuation components or remote electronic actuation components. Examples of suitable valves are ball valves, flapper valves and sleeve valves."

Figure 2:
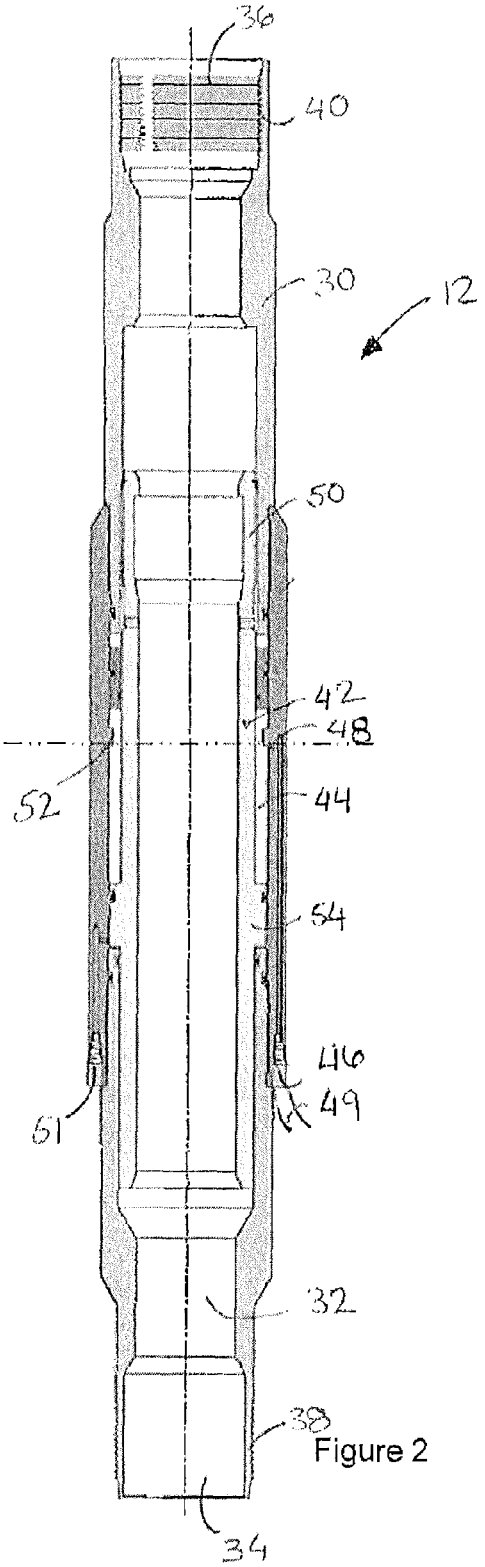
FIG. 2 is a schematic representation of the actuating apparatus in accordance with an embodiment of the present invention.

FIG. 2 illustrates a schematic representation of an actuating apparatus 12 according an embodiment of the present invention. The actuating apparatus 12 provides a secondary actuator operable to close a downhole valve 10 (see FIG. 1) that has failed to close under primary actuation, such as by applying fluid pressure via control lines from surface.

The actuating apparatus 12 according to an embodiment of the present invention comprises a tubular body 30, which includes an axial bore 32 between an inlet end 34 and an outlet end 36. The inlet 34 and the outlet 36 each comprise a threaded connection 38, 40 for attachment to the production tubing 22 (see FIG. 1) of a downhole assembly.

The actuating apparatus 12 also comprises an operating sleeve 42 which is movable relative to the body 30 as described further below with reference to FIG. 3.

The body 30 and the sleeve 42 are assembled coaxially such that an annular reservoir 44 is defined between them. The annular reservoir 44 contains hydraulic fluid which is compressed and displaced upon displacement of the sleeve 42 due to the action of removal of the stinger (not illustrated).

The body 30 includes an outlet port 46 on the outside of the body 30 and an inlet port 48 open to the inside of body 30, where the inlet port 48 is arranged to receive fluid from the annular reservoir 44 upon displacement of the sleeve 42 due to the action of removal of the stinger.

The outlet port 46 is in fluid communication with a conduit 49 that fluidly couples the annular reservoir 44 of the actuating apparatus 12 with the downhole valve assembly 10 in a region downhole of the actuating apparatus 12.

The operating sleeve 42 moves by the action of retrieval/withdrawal of a stinger (not illustrated) from the completion assembly 100.

The stinger (not illustrated) includes a mechanical coupling device such as collet fingers that are operable to engage with the profiled section 50 of the sleeve 42 such that the stinger engages with and pulls the sleeve 42 as the stinger is pulled in an uphole direction from the completion assembly 100. The sleeve 42 reaches a stop 52 inside the body 30, at which point the stinger can be disengaged from the sleeve 42.

Figure 3:
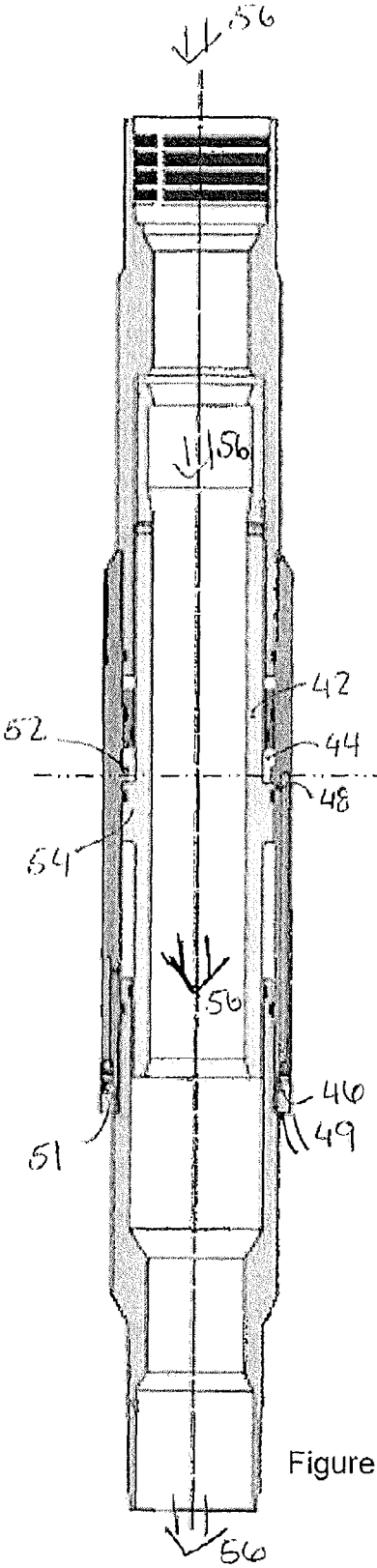
FIG. 3 is a schematic representation of the actuating apparatus in the operating configuration.

The sleeve 42 moves from the position illustrated in FIG. 2 to the position illustrated in FIG. 3. As the sleeve 42 moves, by action of the stinger, fluid is displaced from the annular reservoir 44 through the inlet port 48 and out of the outlet port 46 such that fluid pressure is applied downhole to close the downhole valve 10 that has failed to close under primary actuation.

The sleeve 42 incorporates a piston member 54 that acts to compress and displace the fluid such that the downhole valve 10 can be closed or opened if the actuation is reversed.

The actuating apparatus includes a return port 51. The return port 51 provides a path for fluid that is displaced from the downhole valve 10 upon actuation of the valve via the actuating apparatus 12.

In the situation where the valve 10 is closed by the actuating apparatus 12 and subsequent to closing the valve 10 by action of the actuating apparatus 12 a pressure test may be carried out, for example, by applying tubing pressure 56 (as illustrated in FIG. 3) from an uphole region of the valve 10 to ensure that the valve 10 is fully closed and to ensure that the well is shut off. When it is established that the well is shut off, the stinger can be fully withdrawn to allow workover operation to begin.

The axial bore 32 of the actuating apparatus 12 is permanently open such that it does not impede flow in a producing well and also during preparation for workover, where the axial bore 32 facilitates application of fluid pressure to the downhole valve 10 such that the status of the well is assured before proceeding with workover.

Following workover, it may be the case that the well is to resume production. Therefore, the axial bore 32 again does not impede flow when the valve 10 is opened again.

In summary, the embodiment described above may be used in preparation of a well for workover of a well. The actuating apparatus 12 provides a back-up and contingency device that offers reassurance and certainty that downhole valves are closed such that a well is ready for workover.

While specific embodiments of the present invention have been described above, it will be appreciated that departures from the described embodiments may still fall within the scope of the present invention.

What is claimed is:

1. An actuating apparatus for operating a downhole valve; comprising:
- a tubular body comprising an axial bore;
- a fluid reservoir defined within the axial bore and fluidly coupled to the downhole valve; and
- a valve operating member movable relative to the tubular body between a first position and a second position to displace fluid contained within the fluid reservoir as the valve operating member moves to actuate the downhole valve, the valve operating member comprising:
  - a hollow tubular sleeve located coaxially within the axial bore of the tubular body;
  - a piston member coupled to the tubular sleeve, at least a portion of the piston member extending radially away from the tubular sleeve and into the fluid reservoir; and
  - a collet-engageable coupling profile configured to be reversibly mechanically engaged with a removable downhole tool to facilitate movement of the valve operating member; and
- a fluid return port configured to receive a flow of fluid displaced from the downhole valve as the valve is actuated by the valve operating member.

2. The actuating apparatus as claimed in claim 1, wherein the reservoir comprises an annulus region defined between the valve operating member and the tubular body.

3. The actuating apparatus as claimed in claim 1, wherein the fluid reservoir comprises an inlet port and an outlet port.

4. The actuating apparatus as claimed in claim 3, wherein the outlet port is fluidly coupled to the downhole valve.

5. The actuating apparatus as claimed in claim 4, further comprising a conduit extending directly from the outlet port to the downhole valve.

6. The actuating apparatus as claimed in claim 5, wherein the conduit is incorporated within a downhole completion assembly.

7. The actuating apparatus as claimed in claim 1, wherein the portion of the piston member comprises an annular flange projecting radially outward from an outer surface of the tubular sleeve.

8. The actuating apparatus as claimed in claim 7, wherein the piston member is adapted to displace fluid contained in the fluid reservoir via an outlet port of the fluid reservoir to an inlet port of the downhole valve such that the downhole valve is actuated.

9. The actuating apparatus as claimed in claim 7, wherein the portion of the piston member is arranged proximate a downhole side of the fluid reservoir when the valve operating member is in the first position.

10. The actuating apparatus as claimed in claim 1, wherein movement of the valve operating member from the first position to the second position comprises an axial stroke that displaces the fluid from the fluid reservoir and simultaneously provides sufficient fluid pressure to actuate the downhole valve over at least a portion of the axial stroke.

11. The actuating apparatus as claimed in claim 10, wherein the movement of the valve operating member comprises axial movement in an uphole direction, and wherein the uphole movement of the valve operating member displaces the fluid in a generally downhole direction to actuate the downhole valve.

12. The actuating apparatus as claimed in claim 10, wherein the fluid pressure is sufficient to open the downhole valve.

13. The actuating apparatus as claimed in claim 10, wherein the fluid pressure is sufficient to close the downhole valve.

14. The actuating apparatus as claimed in claim 1, wherein the tubular body, the valve operating member and the fluid reservoir are located uphole of the downhole valve.

15. The actuating apparatus as claimed in claim 1, wherein the fluid contained within the fluid reservoir comprises hydraulic fluid.

16. The actuating apparatus as claimed in claim 1, wherein the fluid reservoir is separated from the axial bore of the tubular body.

17. A downhole completion assembly, comprising:
- a downhole valve; and
- a secondary actuating apparatus for operating the downhole valve, comprising:
  - a tubular body comprising an axial bore; and
  - a valve operating member comprising:
    - a hollow tubular sleeve located coaxially within the axial bore of the tubular body; and
    - a piston member comprising an annular flange projecting radially outward from an outer surface of the tubular sleeve;

a collet-engageable coupling member configured to be reversibly mechanically engaged with a removable downhole tool to facilitate movement of the valve operating member; and a fluid reservoir comprising an annular region defined between the valve operating member and the tubular body;

wherein the valve operating member is movable relative to the tubular body by an external force along an uphole axial stroke between a first position and a second position, such that fluid contained within the fluid reservoir is displaced by the piston member and conveyed in a generally downhole direction, as the valve operating member moves via the collet-engageable coupling member, with sufficient fluid pressure to actuate the downhole valve, wherein the downhole valve is located downhole of the tubular body and the valve operating member, and comprises a primary actuating apparatus operable to open and close the valve independent of movement by the valve operating member.

18. A downhole completion assembly, comprising:

a downhole valve comprising a primary actuating apparatus independently operable to open and close the downhole valve; and a secondary actuating apparatus fluidly coupled to the downhole valve and configured to operate entirely independent of the primary actuating apparatus, the secondary actuating apparatus comprising:

a tubular body comprising an axial bore;

a valve operating member comprising a hollow tubular sleeve located coaxially within the axial bore of the tubular body;

a fluid reservoir comprising an annular region defined between the valve operating member and the tubular body; and a collet-engageable coupling member configured to be reversibly mechanically engaged with a removable downhole tool to facilitate movement of the valve operating member; and wherein the valve operating member is movable relative to the tubular body between a first position and a second position to displace fluid contained within the fluid reservoir as the valve operating member moves, to actuate the downhole valve.

* * * * *